US006178769B1

(12) United States Patent
Bartolles

(10) Patent No.: US 6,178,769 B1
(45) Date of Patent: Jan. 30, 2001

(54) COOLING APPARATUS FOR THE BREECH REGION OF A WEAPON BARREL

(75) Inventor: Rolf Bartolles, Korschenbroich (DE)

(73) Assignee: Rheinmetall W & M GmbH, Unterlüss (DE)

( * ) Notice: Under 35 U.S.C. 154(b), the term of this patent shall be extended for 0 days.

(21) Appl. No.: 09/392,446

(22) Filed: Sep. 9, 1999

(30) Foreign Application Priority Data

Sep. 17, 1998 (DE) ..... 198 42 542

(51) Int. Cl.[7] ..... F25D 17/04; F41A 13/00
(52) U.S. Cl. ..... 62/404; 62/419; 89/14.1
(58) Field of Search ..... 62/62, 404, 407, 62/409, 411, 419; 89/14.05, 14.1

(56) References Cited

U.S. PATENT DOCUMENTS 4,203,364 * 5/1980 Dobbs .
4,884,490 * 12/1989 Hurlemann ..... 89/14.1
5,202,530 * 4/1993 Stephens ..... 89/14.1 X
5,355,765 * 10/1994 Rogers .
5,837,921 * 11/1998 Rinaldi et al. ..... 89/14.1

FOREIGN PATENT DOCUMENTS 38 27 740 2/1990 (DE) .
40 22 541 12/1992 (DE) .
40 22 542 3/1994 (DE) .

* cited by examiner

*Primary Examiner*—William Doerrler
*Assistant Examiner*—Chen-wen Jiang
(74) *Attorney, Agent, or Firm*—Venable; Gabor J. Kelemen

(57) ABSTRACT

A cooling apparatus for introducing a coolant fluid into a weapon barrel through a breech end thereof for cooling internal wall faces of a loading chamber of the barrel. The cooling apparatus includes a bellows having a circumference provided with a plurality of holes. The bellows has a retracted state and an elongated, tubular expanded state and is introducible into the weapon barrel in the retracted state. The cooling apparatus further has a coolant driving arrangement coupled to the bellows for introducing the coolant into the bellows to place the bellows into the expanded state and to force the coolant out of the bellows through the holes.

8 Claims, 1 Drawing Sheet

13
2
9.1
8
1
6
3
7
11
7
9.2
6
4
8
a
5
l
13

2
9.1
8
1
12
3
10
9.2
4
a
5
8
l

COOLING APPARATUS FOR THE BREECH REGION OF A WEAPON BARREL

CROSS REFERENCE TO RELATED APPLICATION

This application claims the priority of German Application No. 198 42 542.2 filed Sep. 17, 1998, which is incorporated herein by reference.

BACKGROUND OF THE INVENTION

This invention relates to an apparatus for introducing a coolant into the breech-side end of a weapon barrel.

German Offenlegungsschrift (application published without examination) 38 27 740 discloses a cooling apparatus for a large-caliber weapon barrel wherein a cradle tube rigidly connected with the cradle constitutes the outer wall of a jacket for guiding the coolant therein. The cradle tube, for ensuring an intensive heat removal, has channels in the region of the rearward and forward barrel support bushings for supplying and removing a gaseous or liquid coolant. Such a cooling apparatus is a fixed component of the large-caliber weapon barrel and thus has to be manufactured separately for each weapon.

German Patent No. 40 22 542 discloses a cooling apparatus which, for supplying a coolant to the chamber of a weapon barrel, has a nozzle for spraying the inner barrel face of the chamber with a coolant. The nozzle extends, by means of a central connecting tube, into the frontal half of the chamber and the coolant is pumped through the connecting tube to the nozzle. Since such a cooling apparatus has to be manually inserted into the chamber, risks are high that the tube and nozzle are not centrally guided and may thus be damaged or destroyed. Further, such an apparatus is not capable of ensuring a uniform cooling of the entire chamber.

German Patent No. 40 22 541 also discloses an apparatus for introducing a coolant into the chamber of a weapon barrel. The cooling apparatus has a coolant container which is introducible into the weapon chamber and which is composed of a jacket and a container bottom connected therewith. The coolant is driven out of the container towards the weapon muzzle through openings provided in the container. It is a disadvantage of such an apparatus that the cooling process affects mainly the rearward portion of the loading chamber rather than the frontal portion where maximum loading temperatures prevail.

SUMMARY OF THE INVENTION

It is an object of the invention to provide an improved cooling apparatus of the above-outlined type which ensures with simple means a uniform and effective cooling of the entire loading chamber during firing pauses.

This object and others to become apparent as the specification progresses, are accomplished by the invention, according to which, briefly stated, the cooling apparatus for introducing a coolant fluid into a weapon barrel through a breech end thereof for cooling internal wall faces of a loading chamber of the barrel includes a bellows having a circumference provided with a plurality of holes. The bellows has a retracted state and an elongated, tubular expanded state and being introducible into the weapon barrel in the retracted state. The cooling apparatus further has a coolant driving arrangement coupled to the bellows for introducing the coolant into the bellows to place the bellows into the expanded state and to force the coolant out of the bellows through the holes.

By using a bellows which upon introduction into the barrel from the breech side extends, in its expanded state, into the frontal half of the barrel chamber and which has circumferentially distributed openings, a simple cooling apparatus is provided which results in a reduction of pauses between shots by virtue of its simple operation. The coolant, preferably air, is driven into the bellows by a pressure generating apparatus, for example, a high-power blower which may be flanged to the bellows. The compressed air exits the bellows openings as the bellows expands and contacts the inner face of the weapon barrel ensuring a cooling of the entire barrel chamber. As an alternative, the coolant may be water, driven by a suitable pump. The installation and removal of the cooling apparatus may be performed in a few seconds.

The bellows is made of a flexible material and is preferably closed at its frontal end so that the bellows may expand abruptly when the coolant is introduced thereinto. The diameter of the bellows corresponds approximately to the inner diameter of the weapon barrel while ensuring that a small clearance between the two components is preserved to allow the exiting coolant to escape in the direction of the barrel muzzle. The cooling apparatus is secured preferably with a simple clamping apparatus to a breech ring of the weapon barrel. The high-performance blower may be directly attached to the weapon barrel in a central alignment therewith or may be mounted on a tower and connected by a hose with the bellows.

DESCRIPTION OF THE PREFERRED EMBODIMENT

Figure 1:
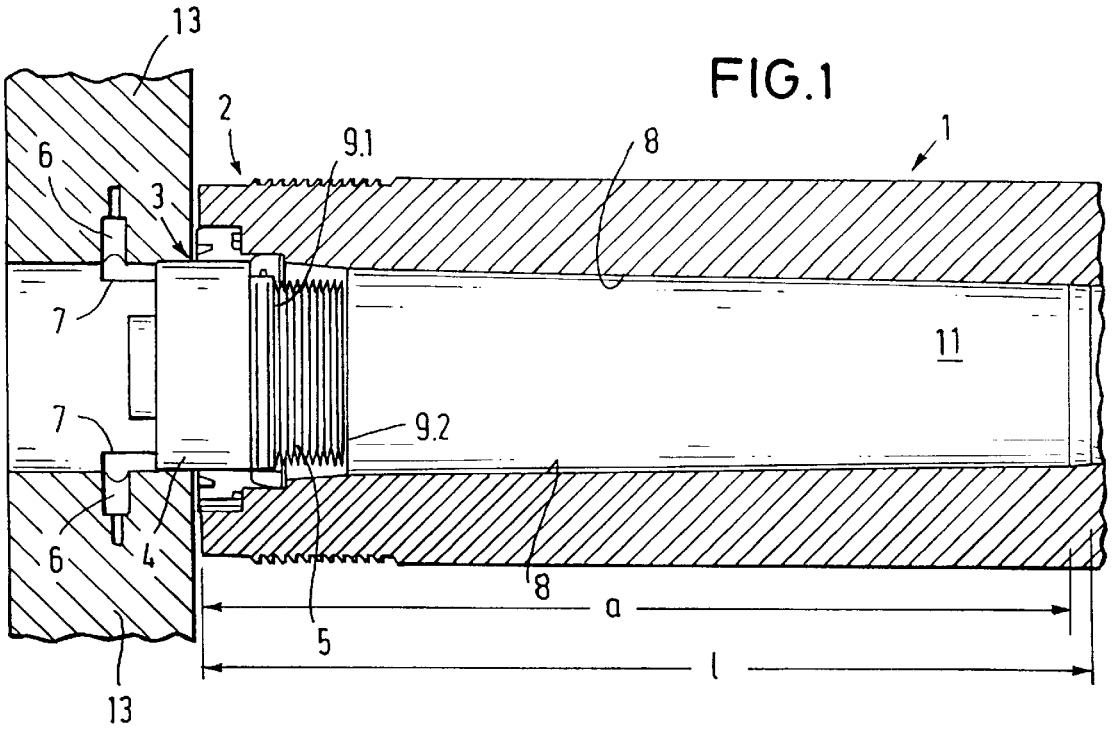
FIG. 1 is an axial sectional view of a weapon barrel and a preferred embodiment of a cooling apparatus disposed therein and depicted in a collapsed (retracted) state.
Figure 2:
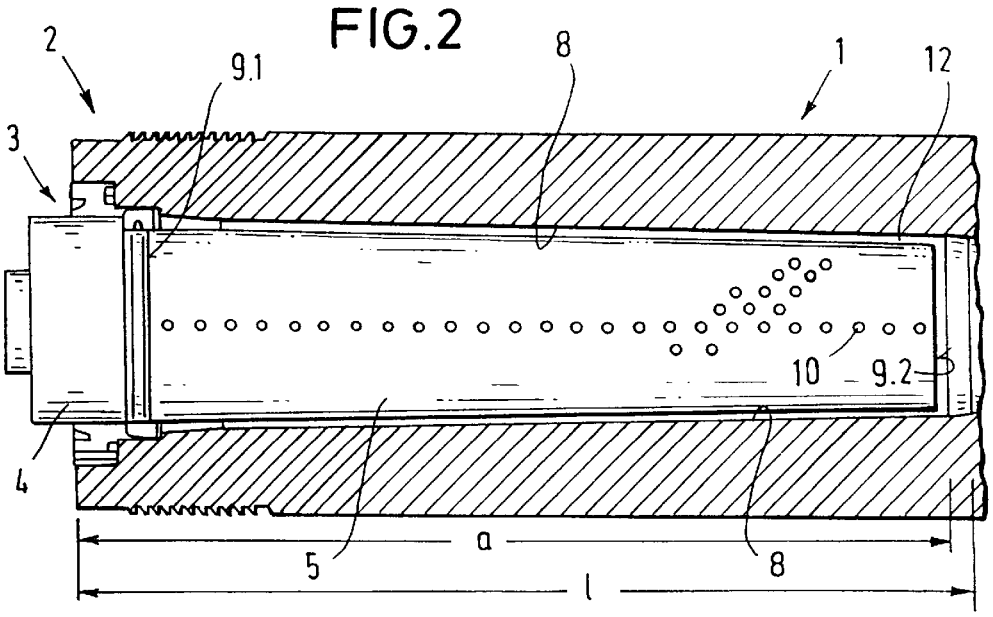
FIG. 2 is a view similar to FIG. 1 showing the cooling apparatus in an expanded (deployed) state.

FIGS. 1 and 2 schematically show a barrel 1 of a large-caliber weapon, such as a howitzer. A cooling apparatus 3 structured according to the invention is disposed in the rearward end 2 of the weapon barrel 1.

The cooling apparatus 3 is formed of a pressure generating apparatus 4, such as a high-power blower and a bellows 5 flanged or screwed to the blower 4. The blower 4, in turn, may be held in bores 6 of the breechblock 13 in a readily releasable manner by lugs 7 carried by the housing of the blower 7. For such an installing and removal operation, the breechblock (not shown in detail) is lifted a few millimeters by a manual opening lever. As an alternative, a simple securement of the blower 4 may be ensured by utilizing the friction force between the breechblock (by virtue of its weight) and the closing springs and the blower 4.

The bellows 5 is preferably of an elastic material such as rubber or a soft plastic and is centrally arranged within the weapon barrel 1. The bellows 5 may have any desired shape, for example, that of a body of revolution having a linear generatrix and having circular or polygonal end faces. The outer diameter of the preferably cylindrical bellows 5 which has circular end faces 9.1 and 9.2 is preferably 1–5% less than the inner diameter of the chamber 11 defined by an inner wall face 8 of the weapon barrel 1. The bellows 5 has a plurality of small openings 10 along its circumference as shown schematically in FIG. 2. The openings 10 have their greatest diameter in the expanded state of the bellows 5. The frontal end face 9.2 of the bellows 5 is preferably void of openings. The length of the bellows 5 depends from the length of the chamber 11 of the weapon 1 as well as from the required cooling effect. The blower 4 is supplied with electric energy by non-illustrated conductors.

In case of a high firing frequency and maximum charge the temperature of the inner wall 8 of the weapon barrel 1 increases in a known manner. The region of the chamber 11 which is particularly affected by the high temperatures is located, as known, at a distance a of 900 to 1,000 mm from the breech-side end of the weapon barrel 2. The chamber region which is exposed to the greatest temperature-caused stresses is, in case of a chamber 11 of a length l of, for example, 1200 mm immediately in front of the transition cone to the large caliber bore of the weapon barrel 1 at a distance a of, for example, 900 mm. The cooling apparatus 3 is introduced into the chamber 11 at uniform intervals, as illustrated in FIG. 1, to ensure that the barrel temperature does not exceed the critical temperature (above 152° C.). By means of the blower 4 cold air is driven into the bellows 5 which, as a result, expands progressively along the inner wall 8 of the chamber 11. Between the inner wall 8 and the expanded length of the bellows 5 an annular clearance 12 remains. By virtue of the numerous openings 10 which are provided preferably along the entire length and the entire circumference of the bellows 5 in a uniform manner, the cold air is blown onto the hot barrel wall 8 and the air draws heat from the weapon barrel 1 and is driven by the air behind it through the annular clearance 12 towards the muzzle of the barrel 1. The bellows 5 remains preferably in its expanded (deployed) state during the cooling process.

After the barrel temperature has been sufficiently reduced, the blower 4 is switched off, whereupon the bellows 5 retracts into its initial position and the entire cooling apparatus 3 may be removed from the rearward end 2 of the barrel 1. The cooling period and thus the coolant quantity used may be determined and controlled by a heat sensor arrangement (not shown). Such a control may also be effected manually or by an automatic control which also effect the de-energization of the blower 4.

By virtue of the rapid installation of the cooling apparatus 3 the barrel temperature may be reduced significantly more rapidly. Because of the simple manipulation the cooling process may be performed during firing pauses, for example, during changes in the weapon position. At the same time the firing frequency of the weapon barrel is increased. The installation and removal of the cooling apparatus 3 may be performed in a few seconds and furthermore, no barrel modifications have to be made.

In case air or other gaseous mixtures are used as the coolant, additional erosion phenomena in the weapon barrel 1 are reduced.

As an alternative, the blower 4 may be accommodated in the tower of a howitzer in which case the bellows 5 is coupled with the blower 4 with a flexible hose. In such an arrangement the lug component 7 is expediently mounted on the bellows 5.

Furthermore, a liquid coolant such as cooling water may be used in which case the blower 4 is replaced by a pump to drive the liquid into the bellows 5.

It will be understood that the above description of the present invention is susceptible to various modifications, changes and adaptations, and the same are intended to be comprehended within the meaning and range of equivalents of the appended claims.

What is claimed is:

1. A cooling apparatus for introducing a coolant fluid into a weapon barrel through a breech end thereof for cooling internal wall faces of a loading chamber of the barrel, comprising (a) a bellows having a circumference provided with a plurality of holes; said bellows having a retracted state and an elongated, tubular expanded state; said bellows being introducible into the weapon barrel in said retracted state; and (b) coolant driving means coupled to said bellows for introducing the coolant into said bellows to place said bellows into said expanded state and to force the coolant out of said bellows through said holes.

2. The cooling apparatus as defined in claim 1, wherein said bellows is of a flexible material.

3. The cooling apparatus as defined in claim 1, wherein said coolant is a gas and said coolant driving means is a blower.

4. The cooling apparatus as defined in claim 1, wherein said coolant is a liquid and said coolant driving means is a pump.

5. The cooling apparatus as defined in claim 1, wherein said coolant driving means is directly connected to said bellows whereby said bellows and said coolant driving means form a one-piece unit, further comprising releasable clamping means for attaching said unit directly to the breech-side end of the weapon barrel.

6. The cooling apparatus as defined in claim 1, wherein said coolant driving means is separate from said bellows; further comprising a flexible hose connecting said coolant driving means with said bellows; and releasable clamping means carried by said bellows for attaching said bellows directly to the breech-side end of the weapon barrel.

7. A combination comprising (a) weapon barrel having a breech-side end, inner wall faces and a loading chamber situated in said breech-side end and defined by said inner wall faces; and (b) a cooling apparatus for introducing a coolant fluid into said weapon barrel through said breech end thereof for cooling said inner wall faces of said loading chamber; said cooling apparatus comprising (1) a bellows having a circumference provided with a plurality of holes; said bellows having a retracted state and an elongated, tubular expanded state; said bellows being introducible into and removable from said weapon barrel in said retracted state; and (2) coolant driving means coupled to said bellows for introducing the coolant into said bellows to place said bellows into said expanded state and to force the coolant out of said bellows through said holes against said inner wall faces; said inner wall faces and said bellows in said expanded state define an annular clearance through which said coolant is expelled.

8. The combination as defined in claim 7, wherein said bellows is a body of revolution having opposite bases of one of circular and polygonal shape.

* * * * *